US005833768A

United States Patent [19]

Kosuge et al.

[11] Patent Number: 5,833,768

[45] Date of Patent: Nov. 10, 1998

[54] GRAIN-ORIENTED ELECTRICAL STEEL SHEET WITH VERY LOW CORE LOSS AND METHOD OF PRODUCING THE SAME

[75] Inventors: Kenji Kosuge; Mikio Itoh; Shinji Ueno; Haruo Hukazawa; Takashi Yoshimura, all of Himeji, Japan

[73] Assignee: Nippon Steel Corporation, Tokyo, Japan

[21] Appl. No.: 612,611

[22] Filed: Mar. 8, 1996

Related U.S. Application Data

[60] Continuation of Ser. No. 310,051, Sep. 22, 1994, abandoned, which is a division of Ser. No. 180,372, Jan. 12, 1994, abandoned.

[30] Foreign Application Priority Data

| | | | |
|---|---|---|---|
| Jan. 12, 1993 | [JP] | Japan | 5-003439 |
| Aug. 24, 1993 | [JP] | Japan | 5-209575 |
| Aug. 24, 1993 | [JP] | Japan | 5-209576 |

[51] Int. Cl.[6] ..... C21D 8/12

[52] U.S. Cl. ..... 148/111; 148/113

[58] Field of Search ..... 148/111, 112, 148/113, 121

[56] References Cited

U.S. PATENT DOCUMENTS

| | | | |
|---|---|---|---|
| 2,473,156 | 6/1949 | Littmann | 148/111 |
| 2,599,340 | 6/1952 | Littmann et al. | 148/12.5 |
| 3,159,511 | 12/1964 | Taguchi et al. | 148/111 |
| 3,932,234 | 1/1976 | Imanaka et al. | 148/112 |
| 4,469,533 | 9/1984 | Inokuti et al. | 148/111 |
| 4,579,608 | 4/1986 | Shimizu et al. | 148/111 |
| 4,595,426 | 6/1986 | Iwayama et al. | 148/111 |
| 4,878,959 | 11/1989 | Stroble et al. | 148/111 |

FOREIGN PATENT DOCUMENTS

| | | | |
|---|---|---|---|
| 008385 | 3/1980 | European Pat. Off. . | |
| 0334223 | 9/1989 | European Pat. Off. . | |
| 1508414 | 10/1969 | Germany . | |
| 30-3651 | 5/1955 | Japan . | |
| 40-15644 | 7/1965 | Japan . | |
| 51-13469 | 4/1976 | Japan . | |
| 54-13846 | 6/1979 | Japan . | |
| 57-2252 | 1/1982 | Japan . | |
| 58-2569 | 1/1983 | Japan . | |
| 59-177349 | 10/1984 | Japan | 148/308 |
| 63-130747 | 6/1988 | Japan | 148/308 |
| 1-290716 | 11/1989 | Japan . | |
| 1459644 | 12/1976 | United Kingdom . | |

OTHER PUBLICATIONS

Patent Abstracts of Japan, vol. 5, No. 136 (C–69) (808) Aug. 28, 1981 & JP–A–56 072 122 (Shin Nippon Seitetsu), Jun. 16, 1981.

Nozawa et al., "Relationship Between Total Losses Under Tensile Stress in 3 Percent Si–Fe Single Crystals and Their Orientations Near (110)[001]", *IEEE Transactions on Magnetics*, vol. MAG–14, No. 4, 1978, New York, U.S., pp. 252–257.

Patent Abstracts of Japan, vol. 17, No. 361 (C–1080) Jul. 8, 1993 & JP–A–05 051 640 (Reiko Kobayashi), Mar. 2, 1993.

Patent Abstracts of Japan, vol. 17, No. 339 (C–1075) Jun. 28, 1993 & JP–A–05 039 526 (Kawasaki Steel), Feb. 19, 1993.

*Primary Examiner*—Sikyin Ip

*Attorney, Agent, or Firm*—Wenderoth, Lind & Ponack, L.L.P.

[57] ABSTRACT

A method of producing a grain-oriented electrical steel sheet with a very low core loss comprises the steps of obtaining a rolled strip of final product thickness using as a starting material molten steel consisting of not more than 0.10 wt % C, 2.5–7.0 wt % Si, ordinary inhibitor components and the balance of iron and unavoidable impurities, heating the strip to a temperature range of not less than 700° C. at a heating rate of not less than 80° C./s and within 0.1 second after the maximum temperature has been reached cooling the strip at a cooling rate of not less than 50° C./s, and subjecting the strip to decarburization annealing and final finish annealing.

3 Claims, 2 Drawing Sheets

GRAIN-ORIENTED ELECTRICAL STEEL SHEET WITH VERY LOW CORE LOSS AND METHOD OF PRODUCING THE SAME

This application is a continuation of Ser. No. 08/310,051 filed Sep. 22, 1994 now abandoned, which is a division of Ser. No. 08/180,372 filed Jan. 12, 1994, now abandoned.

BACKGROUND OF THE INVENTION

1. Field of the Invention

The present invention relates to a grain-oriented electrical steel sheet with very low core loss owing to a Si content of 2.5–7.0%, high density grain orientation in the (110) [001] direction and an unprecedentedly fine grain diameter.

2. Description of the Prior Art

The magnetic properties of a grain-oriented electrical steel sheet are generally evaluated in terms of both core loss property and magnetization property. Improving the magnetization property is an effective way of reducing equipment size by increasing the designed magnetic flux density. On the other hand, lowering core loss reduces the amount of energy that a piece of electrical equipment utilizing the grain-oriented electrical steel sheet loses in the form of heat energy and is therefore an effective way of lowering power consumption. Improvement of magnetization property and reduction of core loss is also possible by aligning the <100> axes of the product grains in the rolling direction and, in recent years, considerable research toward enhancing this alignment has led to the development of various production technologies.

The result has been that the technologies commonly used in the manufacture of typical grain-oriented electrical steel sheet now fall under three types.

The first of these, disclosed in JP-B-30-3651, is a two-pass cold rolling method utilizing MnS as an inhibitor. Although this method achieves a relatively good core loss property owing to the small diameter of the secondary recrystallization grains, it is unable to provide a high magnetic flux density.

For overcoming this problem, JP-B-40-15644 proposes a second method aimed at obtaining a high flux density. This production method utilizes a combination AlN +MnS as inhibitor and conducts the final cold rolling at a strong reduction ratio of 80%. Since the secondary recrystallization grain (110) [001] orientation density is high according to this method, the method can provide a grain-oriented electrical steel sheet with a high flux density, namely with a $B_8$ value of not less than 1.870 (T).

JP-B-51-13469 teaches the third production method, which adopts MnS or a combination of MnSe+Sb as inhibitor and utilizes two-pass cold rolling.

Core loss can be broadly divided into hysteresis loss and eddy current loss. Physical factors that affect hysteresis loss include not only the aforesaid grain orientation but also the steel purity and internal strain. Physical factors that affect eddy current loss include the electrical resistance of the steel sheet (content of Si etc.), the sheet thickness, the size of the magnetic domains (grain size) and the tensile force acting on the sheet. Since eddy current loss accounts for more than three-fourths of the total core loss of ordinary grain-oriented electrical steel sheet, the total core loss can be more effectively lowered by reducing the eddy current loss than by reducing the hysteresis loss.

Thus, although the grain-oriented electrical steel sheet provided by the second production method mentioned above may be able to achieve high density secondary recrystallization orientation in the (110) [001] direction and thereby attain a high flux density of $B_8$ =1,870 (T) or higher, the fact that its secondary recrystallization grain diameter is on the order of 10 mm means that it is left with the problem of wide magnetic domains that affect the eddy current loss. Various methods of subdividing magnetic domains have been proposed to overcome this problem, such as the method of treating steel sheet with a laser beam taught by JP-B-57-2252 and the method of imparting mechanical strain to steel sheet taught by JP-B-58-2569.

There were then developed production methods which, by achieving fine secondary recrystallization grain diameters, were able to provide grain-oriented electrical steel sheet with lower core loss than in the past. JP-A-1-290716, for example, teaches a method characterized in that steel strip rolled at normal temperature is subjected to ultra-fast annealing to a temperature of 675° C. or higher at a heating rate of at least 100° C./s, decarburized, and then subjected to final high-temperature annealing for secondary grain growth, whereby the strip is able to maintain the reduced secondary grain recrystallization size and remain without significant change even after relief annealing, thus achieving an improved core loss property. While this method is in fact able to achieve some degree of reduction in secondary recrystallization grain size, the secondary recrystallization grain (110) [001] orientation density is not high and, as a result, it has been found that the core loss value is not so good.

Any attempt, such as in JP-A-1-290716, to obtain the desired low core loss by reducing the average secondary recrystallization grain diameter so as to realize a smaller magnetic domain width is bound to experience an increase in the ratio of the small secondary recrystallization grains whose (110) [001] axes deviate from the rolling direction and thus be prevented from achieving a large improvement in the core loss value at the time the surface of the steel sheet is coated with a forsterite or insulating coating.

SUMMARY OF THE INVENTION

One object of this invention is to provide a grain-oriented electrical steel sheet which has very low core loss and exhibits both high secondary recrystallization grain (110) [001] orientation density and small secondary recrystallization grain diameter, and another is to provide a method of producing the grain-oriented electrical steel sheet. The invention is characterized by rapid heating immediately followed by cooling.

DETAILED DESCRIPTION OF THE INVENTION

Figure 1A:
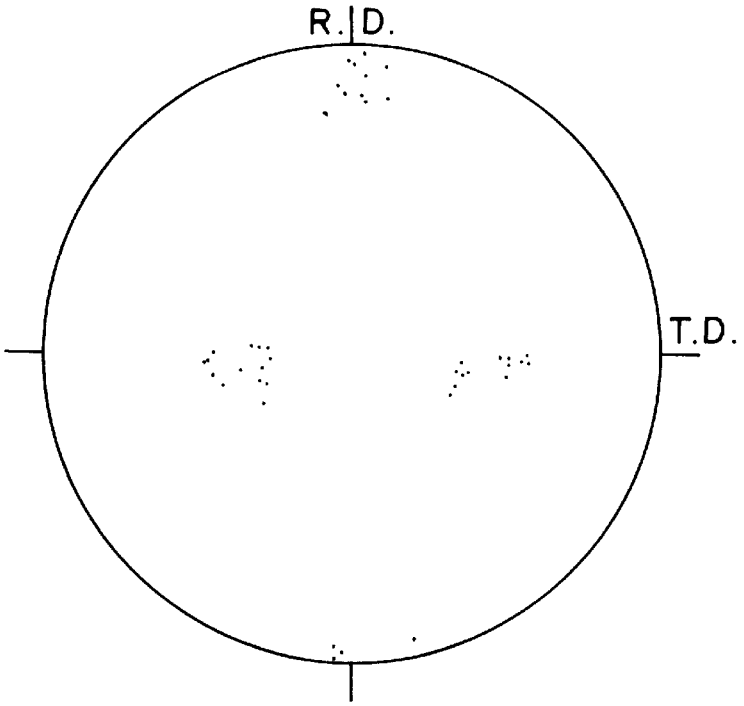
FIG. 1(*a*) and 1(*b*) are pole figures showing how the orientation of secondary recrystallization grains measuring 5 mm or less in diameter varies depending on whether or not the steel sheet is cooled after rapid heating.

One aspect of the present invention provides a method of producing a grain-oriented electrical steel sheet with a very low core loss comprising the steps of obtaining a rolled strip of final product thickness using as a starting material molten steel consisting of not more than 0.10 wt % C, 2.5–7.0 wt % Si, ordinary inhibitor components and the balance of iron and unavoidable impurities, heating the strip to a temperature range of not less than 700° C. at a heating rate of not less than 80° C./s and within 0.1 second after the maximum temperature has been reached cooling the strip at a cooling rate of not less than 50° C./s, and subjecting the strip to decarburization annealing and final finish annealing.

Another aspect of the invention provides a method of producing a grain-oriented electrical steel sheet with a very low core loss wherein the step of rapidly heating and cooling the strip is conducted by passing electric current through the strip between rolls to heat the strip and cooling it by a roll on the heated side.

Another aspect of the invention provides a method of producing a grain-oriented electrical steel sheet with a very low core loss wherein the step of rapidly heating and cooling the strip is conducted in a non-oxidizing atmosphere.

Another aspect of the invention provides a method of producing a grain-oriented electrical steel sheet with a very low core loss wherein the strip is heat treated by being held for not less than one minute in a temperature range not lower than 100° C. one or more times at intermediate thickness stages in the course of rolling to final product thickness.

The grain-oriented electrical steel sheet according to the aforesaid production method features an orientation of the crystal grains with respect to the ideal (110) [001] direction which, on average, deviates by not more than 4° in the rolling direction and 1°–3° in the plane direction of the sheet, while also exhibiting grain diameters of 1–10 mm. As a result, it has very low core loss.

Moreover, by subjecting the grain-oriented electrical steel sheet produced by the aforesaid method to magnetic domain subdivision processing there is obtained a grain-oriented electrical steel sheet exhibiting outstanding magnetic properties.

The invention will now be explained in detail.

In the production of grain-oriented electrical steel sheet a high degree of secondary recrystallization is induced during the final annealing step of the production process so as to obtain what is referred to as a Goss texture. The Goss texture is obtained by suppressing the growth of coarse primary recrystallization grains and within a certain temperature range selectively growing only recrystallization grains with (110) [001] orientation. In other words, it is necessary to provide a base material amenable to secondary recrystallization. This requires that fine inclusions be evenly dispersed throughout the base material as primary recrystallization suppressing agents (inhibitors). It is generally accepted that the size of these precipitants should preferably be on the 100 Å order.

As explained in JP-A-1-290716, rapid heating produces a texture with a larger number of (110) [001] oriented grains following primary recrystallization than does ordinary heating and since these grains serve as nuclei for secondary recrystallization, it becomes possible to obtain somewhat smaller secondary recrystallization grains. Moreover, although it is claimed that the mechanism achieved in the production method according to the earlier mentioned patent publication involves two changes, one in the primary recrystallization structure prior to the final decarburization annealing step and another in the primary recrystallization structure prior to the high-temperature annealing step, it was found that the primary recrystallization structure control by this production method alone is not sufficient.

Various studies were therefore conducted regarding factors making it possible to obtain fine secondary recrystallization grains. As a result, it was found that by heating the strip to a temperature range of not less than 700° C. at a heating rate of not less than 80° C./s and then within 0.1 second after reaching the maximum temperature using a roll on the heated side to cool the strip at a cooling rate of not less than 50° C./s, the precipitates do not enlarge but can be maintained at an optimum precipitation size on the order of 100 Å in the high temperature region. Owing to this finding, it became possible to obtain an unprecedentedly small secondary recrystallization grain diameter and thus produce a grain-oriented electrical steel sheet with a very low core loss.

Figure 1B:
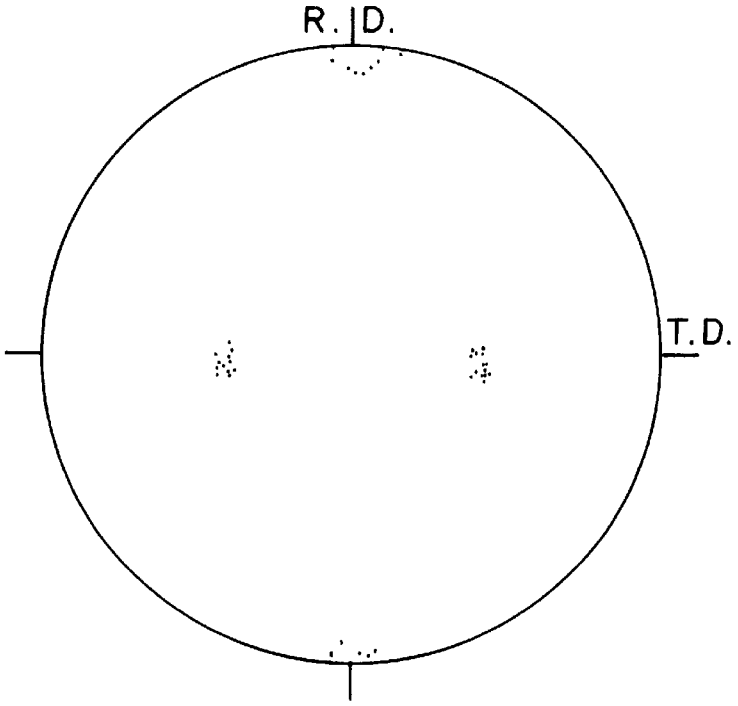

FIG. 1(*a*) and 1(*b*) are (100) pole figures of fine secondary recrystallization grains measuring not more than 5 mm in diameter. The thickness of the product sheets was 0.22 mm. FIG. 1(*a*) shows the orientation of fine secondary recrystallization grains by a prior art method in which heating was conducted at the rate of 300° C./s at the time of decarburization annealing and FIG. 1(*b*) shows the orientation of fine secondary recrystallization grains by the present invention in which, at the time of decarburization annealing, heating was conducted at the rate of 300° C./s up to 850° C. and then within 0.1 second cooling was conducted at the rate of 200° C./s down to 750° C., followed by secondary recrystallization. By the present invention, even the fine secondary recrystallization grains exhibited (110) [001] orientation aligned in the rolling direction. The products exhibited core loss properties of $W_{17/50}$=0.90 (W/kg) in the case of FIG. 1(*a*) and $W_{17/50}$=0.81 (W/kg) in the case of FIG. 1(*b*).

The inventors also discovered that in addition to controlling primary recrystallization it is also important to control the oxide coating. That is to say, the secondary recrystallization has to be well timed with respect to the formation of forsterite by the reaction with MgO.

When, as in JP-A-1-290716, an attempt is made to realize the desired low core loss by reducing the magnetic domain width through reduction of the average secondary recrystallization grain diameter, a problem invariably arises when forsterite ($2MgO.SiO_2$) or the like is formed during the ensuing final annealing by coating with MgO. Specifically, the coating tension is not adequate for improving the magnetic properties.

A careful investigation of the cause behind this revealed that the formation of forsterite is greatly impaired by the presence of an oxide film that forms during the heating phase of the decarburization annealing. Since the oxide film is formed under sudden exposure to high temperature owing to the rapid heating of the steel strip, the formation process differs greatly from that of ordinary oxide film in that it is characterized by preferential formation of fayalite ($2FeO.SiO_2$). In ordinary prior art heating (20° C./s), $SiO_2$ and fayalite form after decarburization has started.

For overcoming the foregoing problem, the inventors sought to suppress fayalite formation during the heating phase as much as possible and found that when the rapid heating is conducted in a non-oxidizing atmosphere, the formation of fayalite is suppressed and the formation of forsterite by coating with MgO during the following final annealing is achieved in excellent condition, thus providing a method of producing grain-oriented electrical steel sheet with a very low core loss.

In addition, they discovered that the cold rolling conditions are also important to the improvement of the core loss property.

More specifically, they discovered that heat treatment at a prescribed temperature conducted at an intermediate sheet thickness stage of the cold rolling causes interstitial solid solution elements such as solute C to attach to the dislocations formed by the cold rolling and thus alter the deformation mechanism and modify the cold rolled texture. They also found that a heat treatment to a temperature of not less than 700° C. at a heating rate of not less than 80° C./s immediately before decarburization annealing followed by prescribed cooling makes it possible to obtain fine secondary recrystallization grains which measure not more than several millimeters and whose (110) [001] direction is as close as 2° to the sheet plane direction. Since this results in a large margin for improvement in the core loss value at the time of thereafter applying a coating to the steel sheet surface, it becomes possible to realize a low core loss. According to Nozawa et al. (IEEE, Trans-Mag. Mag-14, No. 4 (1978) 252), the core loss reduction effect is greatest when the secondary recrystallization orientation lies 2° from the sheet plane direction. The present invention can be presumed to achieve a similar effect. Thus, a large improvement in the core loss property is obtained by applying tension to the surface of the steel sheet through the formation of a forsterite or insulation film. The final core loss value achieved is therefore very low.

As disclosed in JP-B-54-13846, the heat effect obtained when the steel strip is held in the temperature range of 50°–350° C. for not less than one minute during cold rolling enables production of a grain-oriented electrical steel sheet exhibiting extremely good magnetic properties. Despite enabling some degree of reduction in core loss, this production method does not achieve a preferable core loss value, however, because the macro secondary recrystallization value is still large (on the 10 mm order).

The reasons for the limits on the steel components and production conditions according to the present invention will now be explained in detail.

The reasons for the limits on the steel components are as follows.

C is limited to a maximum content of 0.10% because at higher content the time required for decarburization becomes so long as to be uneconomical.

Si content is set to a lower limit of 2.5% for improving core loss property and to an upper limit of 7.0% because at higher content cracking is apt to occur during cold rolling, making it difficult to work the steel sheet.

In addition, for producing a grain-oriented electrical steel sheet, the following component elements are preferably added to the steel as ordinary inhibitor components.

When MnS is used as an inhibitor, Mn and S are added. For ensuring appropriate dispersion of the MnS, the Mn content is preferably 0.02–0.15%. S is an element required for the formation of MnS, (Mn.Fe) S. For obtaining an appropriately dispersed state, it is preferably present at 0.001–0.05%.

When AlN is used as an inhibitor, acid soluble Al and N are added. For ensuring appropriate dispersion of the AlN, the acid soluble Al content is preferably 0.01–0.04%. For the same purpose, N is preferably present at 0.003–0.02%.

One or more of Cu, Sn, Sb, Cr and Bi can also be added up to not more than 1.0% for strengthening the inhibitors.

The aforesaid steel melt is formed into a strip of intermediate thickness by the ordinary ingotting or continuous casting method and hot rolling. The strip casting method at this time can also be applied to the invention.

When a nitride is required as an inhibitor, it is preferable to conduct intermediate annealing for 30 seconds –30 minutes at 950°–1200° C. for precipitating AlN or the like.

Next, a strip of final product thickness is obtained by a single rolling or two or more rollings with intermediate annealing. For obtaining a product with high Goss density at this time, it is necessary to use a final reduction rate of not less than 50%. The lower limit of the reduction ratio is set at 50% for obtaining the required Goss nuclei.

For improving the magnetic properties, the cold rolling is conducted in a plurality of passes so that the strip thickness passes through different stages before reaching the final thickness. In at least one of the intermediate strip thickness stages, the strip may be imparted with a heat effect by holding it in a temperature range of not lower than 100° C. for not less than one minute. The lower limit of the temperature is set at 100° C. and the lower limit of the soaking time is set at 1 minute because at below these limits the solute C or the like does not attach to the dislocations, making it difficult to thereafter alter the primary recrystallization texture and sufficiently develop fine secondary recrystallization with (110) [001] aligned with the rolling direction. These cold rollings can be conducted by conventional reverse rolling (e.g., rolling with a Sendzimir mill) or by one-direction rolling (tandem rolling).

Figure 2:
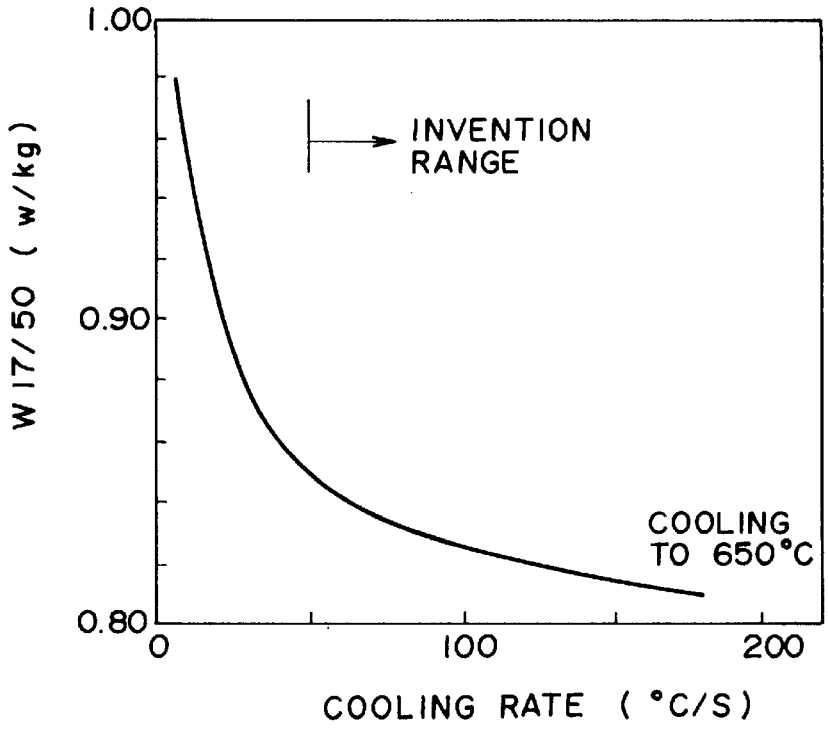
FIG. 2 is a graph showing the relationship between core loss value and the cooling rate by an exit side roll.

The strip rolled to the final product thickness is heat treated by heating to a temperature range of not less than 700° C. at a heating rate of not less than 80° C./s. The lower limit of the heating rate is set at 80° C./sec because at a lower rate the number of (110) [001] oriented grains present after primary recrystallization and serving as nuclei for secondary recrystallization is too small to ensure growth of fine secondary recrystallization grains. The lower limit of the temperature is set at 700° C. because recrystallization does take place at lower temperatures. For preventing enlargement of the fine precipitates in the temperature range to which the strip is heated, the strip is cooled at a cooling rate of not less than 50° C./s. The upper limit of the soaking time after reaching the maximum temperature is set at 0.1 second because a longer soaking time causes enlargement of the precipitants. The lower limit of the temperature range is preferably set at 800° C. because at lower temperatures the precipitation nose shifts greatly. FIG. 2 shows the relationship between the product core loss property and the cooling rate to 650° C. in a 0.22 mm strip that was heated to 825° C. at a heating rate of 180° C./s. A good core loss value was obtained when the cooling rate was not less than 50° C./s.

Figure 3:
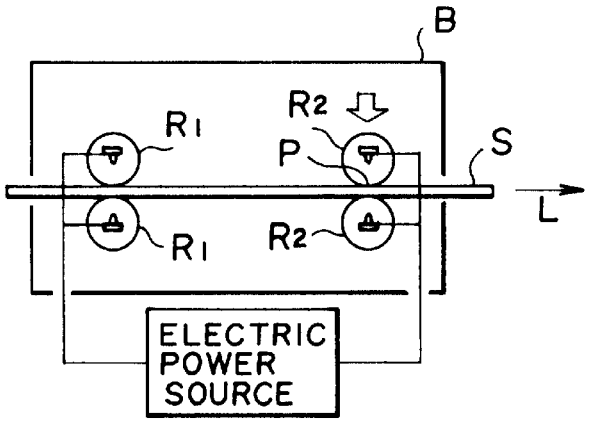
FIG. 3 is a schematic view of an example of an electric heating method according to the invention.

As one method of conducting the aforesaid rapid heating and cooling treatment, it is possible to pass electric current between roll pairs. FIG. 3 is a schematic view showing an example of this method according to the invention. The strip is passed between two pairs of upper and lower rolls and electric current is passed through the strip S between rolls R1 and R2. As a result, the strip S is heated to a temperature range of 700° C. or higher at a heating rate of 80° C./s or higher and then within 0.1 second of reaching its maximum temperature is, owing to the cooling of the point P of the roll R2 on the heated side, cooled by the roll on the heated side at a cooling rate of not less than 50° C./s. By the introduction of slight strain in this way it is further possible to improve the shape of the heated strip.

The properties of the product are further improved when, in the light of concerns relating to film formation and the like, the rapid heating and cooling treatment is conducted in a non-oxidizing atmosphere which, preferably, has a $P_{H2O}/P_{H2}$ of not more than 0.2, because in other atmospheres the formation of fayalite is not suppressed and highly favorable formation of forsterite by coating with MgO cannot be obtained during the ensuing final annealing. By a "non-oxidizing atmosphere" is meant either one containing 1 to 3 members selected from among not more than 0.2% $O_2$, 2% $CO_2$ and $H_2O$ with a dew point of not higher than 5° C. and the balance of $N_2$, Ar or other inert gas or one consisting of $H_2$, CO or other reducing gas. In the case of using $H_2$ or CO, however, it is necessary for $P_{H2O}/P_{H2}$ to be not greater than 0.2 or for $P_{CO2}/P_{CO}$ to be not greater than 1.0

The aforesaid rapid heating and cooling treatment can be conducted before the decarburization annealing is conducted or can be incorporated into the heating phase of the decarburization annealing. The latter arrangement is preferable because it involves fewer steps.

Decarburization annealing is then conducted in a wet hydrogen atmosphere. To prevent degradation of the product's magnetic properties at this time, the carbon content has to be reduced to not more than 0.005%. In the case where the heating temperature of the slab is low and only AlN is used as inhibitor, an additional step of nitriding in an ammonia atmosphere may be conducted. By further applying MgO or some other annealing release agent and then conducting secondary recrystallization and finish annealing at not lower than 1100° C., there is produced a grain-oriented electrical steel sheet with a very low core loss.

By further applying an insulating film over the film of forsterite or the like, there is produced a grain-oriented electrical steel sheet with very low core loss. The aforesaid magnetic properties are such that the low core loss is maintained unchanged even if stress relieving annealing is conducted thereafter.

Since the grain-oriented electrical steel sheet obtained by the aforesaid production method has a grain diameter of 1–10 mm and a grain orientation whose average deviation from the ideal (110) [001] direction is not more than 4° in the rolling direction and between 1° and 3° in the sheet plane direction, it exhibits a very low core loss. The upper limit of the grain diameter is set at not more than 10 mm in order to reduce the eddy current component of the core loss and the lower limit thereof is set at 1 mm because secondary recrystallization is difficult to achieve below this value. Since the larger number of grain boundaries at such a small grain diameter is liable to reduce the magnetic flux density, the deviation of grain orientation from the rolling direction is set at not more than 4°. The upper limit is set at 4° because the lower magnetic flux density at higher values makes it impossible to achieve a reducing effect with respect to the hysteresis component of the core loss. The orientation deviation in the sheet plane direction is limited to 1°–3° because at higher than 3° a decrease in flux density makes it impossible to achieve a reducing effect with respect to the hysteresis component of the core loss and at lower than 1° no core loss reducing effect is obtained by imparting tension.

The aforesaid grain-oriented electrical steel sheet can also be subjected to magnetic domain subdivision treatment for further enhancing the core loss property of the product.

The rapid heating and rapid cooling method according to the present invention makes it possible to produce a grain-oriented electrical steel sheet which, being of unprecedentedly small secondary recrystallization grain diameter, exhibits high flux density and very low core loss.

WORKING EXAMPLES

(Example 1)

A steel melt including the components shown in Table 1 was cast and the resulting slab was heated and then hot rolled into a 2.3 mm hot rolled strip. The strip was annealed at 1100° C. for 5 min, pickled, and then cold rolled to a thickness of 0.22 mm. The resulting rolled strip was heated under various conditions in a direct electric heater equipped with a pair of heating electrodes. In addition, the strip was subjected to various soaking times and cooling conditions immediately after heating. The heating rates, maximum temperatures reached and post-heating cooling conditions are shown in Table 2.

The strip was then decarburization annealed in wet hydrogen, coated with MgO powder, and high-temperature annealed in a hydrogen gas atmosphere at 1200° C. for 10 hours.

Table 2 also shows the secondary recrystallization grain diameter and magnetic properties of the products obtained. When within 0.1 second of being heated to the maximum temperature the steel strip was cooled at a cooling rate of not less than 50° C./s, there was obtained a grain-oriented electrical steel sheet with unprecedentedly fine secondary recrystallization grains and exhibiting a very low core loss.

TABLE 1

| (wt %) | | | | | | |
|---|---|---|---|---|---|---|
| C | Si | Mn | P | S | sol. Al | N |
| 0.070 | 3.15 | 0.083 | 0.008 | 0.023 | 0.0280 | 0.0087 |

TABLE 2

| Test conditions | Heating rate (°C./s) | Max. temp. (°C.) | Soaking time (s) | Cooling rate (°C./s) | Min. cooling temp. (°C.) | Mag. flux density $B_8$ (T) | Core loss $W_{17/50}$ (kg/W) | 2ndry recrystal-lization grain dia. (mm) | Remark |
|---|---|---|---|---|---|---|---|---|---|
| A | 62 | 511 | 0.31 | 20 | 351 | 1.91 | 1.11 | 21.1 | Comp. Ex |
| B | 63 | 845 | 0.03 | 120 | 554 | 1.92 | 1.09 | 23.2 | Comp. Ex |
| C | 134 | 501 | 0.31 | 2200 | 253 | 1.89 | 1.02 | 17.5 | Comp. Ex |
| E | 140 | 623 | 0.32 | 24500 | 452 | 1.90 | 1.05 | 21.0 | Comp. Ex |
| F | 130 | 712 | 0.41 | 24000 | 552 | 1.93 | 0.94 | 9.8 | Comp. Ex |
| G | 139 | 809 | 0.43 | 24000 | 750 | 1.94 | 0.92 | 6.0 | Comp. Ex |
| H | 144 | 851 | 0.42 | 20 | 650 | 1.92 | 0.91 | 5.5 | Comp. Ex |
| I | 132 | 505 | 0.01 | 24000 | 620 | 1.89 | 0.89 | 18.7 | Comp. Ex |
| J | 135 | 620 | 0.02 | 24000 | 600 | 1.90 | 0.91 | 19.5 | Comp. Ex |
| K | 86 | 705 | 0.01 | 220 | 600 | 1.94 | 0.84 | 5.0 | Invnt'n |
| L | 141 | 863 | 0.03 | 240 | 840 | 1.93 | 0.88 | 3.1 | Invnt'n |
| M | 150 | 850 | 0.02 | 1600 | 670 | 1.93 | 0.82 | 3.1 | Invnt'n |
| N | 153 | 845 | 0.02 | 20 | 670 | 1.93 | 0.82 | 7.4 | Comp. Ex |
| O | 250 | 855 | 0.04 | 12000 | 790 | 1.93 | 0.83 | 3.4 | Invnt'n |
| P | 266 | 853 | 0.04 | 22000 | 600 | 1.92 | 0.81 | 3.3 | Invnt'n |

(Example 2)

A steel melt including the components shown in Table 3 was cast and the resulting slab was heated and then hot rolled into a 2.3 mm hot rolled strip. The strip was annealed at 1100° C. for 5 min, pickled, and then cold rolled to a thickness of 0.22 mm. The resulting rolled strip was heated under various conditions in the roll-type direct electric heater shown in FIG. 3. In addition, the exit side roll was preheated and the pass speed controlled to subject the strip to various soaking times and cooling conditions immediately after heating. The heating rates, maximum temperatures reached and exit side roll cooling conditions are shown in Table 4.

The strip was then decarburization annealed in wet hydrogen, nitrided in an ammonia atmosphere, coated with MgO powder, and high-temperature annealed in a hydrogen gas atmosphere at 1200° C. for 10 hours.

Table 4 also shows the secondary recrystallization grain diameter and magnetic properties of the products obtained. When within 0.1 second of being heated to the maximum temperature the steel strip was cooled at a cooling rate of not less than 50° C./s, there was obtained a grain-oriented electrical steel sheet with unprecedentedly fine secondary recrystallization grains and exhibiting a very low core loss.

TABLE 3

| (wt %) | | | | | | |
|---|---|---|---|---|---|---|
| C | Si | Mn | P | S | sol. Al | N |
| 0.050 | 3.15 | 0.083 | 0.008 | 0.0002 | 0.0280 | 0.0087 |

Table 6 shows the magnetic properties of the products obtained. A product with satisfactory magnetic properties was obtained by the electric heating roll method.

TABLE 5

| (wt %) | | | | | | | | |
|---|---|---|---|---|---|---|---|---|
| C | Si | Mn | P | S | sol. Al | N | Cu | Sn |
| 0.070 | 3.05 | 0.082 | 0.010 | 0.022 | 0.0267 | 0.0090 | 0.073 | 0.113 |

TABLE 6

| Test conditions | Mag. flux density $B_8$ (T) | Core loss $W_{17/80}$ (kg/W) | Remark |
|---|---|---|---|
| Electric rolls | 1.95 | 0.78 | Invention |
| Induction heating | 1.92 | 0.89 | Comparative Example |

TABLE 4

| Test conditions | Heating rate (°C./s) | Max. temp. (°C.) | Soaking time (s) | Cooling rate (°C./s) | Min. cooling temp. (°C.) | Mag. flux density $B_8$ (T) | Core loss $W_{17/50}$ (kg/W) | 2ndry recrystal-lization grain dia. (mm) | Remark |
|---|---|---|---|---|---|---|---|---|---|
| A | 62 | 503 | 0.31 | 24000 | 351 | 1.92 | 1.09 | 31.1 | Comp. Ex |
| B | 64 | 852 | 0.03 | 24000 | 554 | 1.91 | 1.10 | 29.2 | Comp. Ex |
| C | 125 | 512 | 0.31 | 22000 | 253 | 1.90 | 0.99 | 18.5 | Comp. Ex |
| E | 131 | 604 | 0.32 | 24000 | 452 | 1.90 | 1.04 | 24.0 | Comp. Ex |
| F | 142 | 713 | 0.41 | 24000 | 552 | 1.94 | 0.93 | 10.8 | Comp. Ex |
| G | 145 | 820 | 0.43 | 24000 | 750 | 1.93 | 0.91 | 6.0 | Comp. Ex |
| H | 150 | 857 | 0.42 | 20 | 650 | 1.93 | 0.89 | 6.5 | Cosp. Ex |
| I | 111 | 510 | 0.01 | 24000 | 620 | 1.90 | 0.90 | 15.7 | Cosp. Ex |
| J | 123 | 606 | 0.02 | 24000 | 600 | 1.89 | 0.91 | 17.5 | Comp. Ex |
| K | 134 | 709 | 0.01 | 220 | 600 | 1.91 | 0.83 | 3.9 | Invnt'n |
| L | 145 | 843 | 0.03 | 240 | 835 | 1.92 | 0.89 | 3.5 | Invnt'n |
| M | 150 | 853 | 0.02 | 22000 | 670 | 1.92 | 0.82 | 4.0 | Invnt'n |
| N | 150 | 853 | 0.02 | 20 | 670 | 1.92 | 0.90 | 6.6 | Comp. Ex |
| O | 250 | 852 | 0.04 | 24000 | 790 | 1.92 | 0.82 | 4.0 | Invnt'n |
| P | 253 | 860 | 0.04 | 22000 | 800 | 1.92 | 0.83 | 3.8 | Invnt'n |

(Example 3)

A steel melt including the components shown in Table 5 was cast and the resulting slab was heated and then hot rolled into a 2.3 mm hot rolled strip. The strip was annealed at 1100° C. for 5 min, pickled, and then cold rolled to a thickness of 0.22 mm. The rolled strip was heated to 851° C. at a heating rate of 250° C./s by two pairs of direct electric heating rolls and 0.01 second after reaching its maximum temperature was cooled by the exit side roll to 810° C. at a cooling rate of 24500° C./s. It was then decarbonization annealed in wet hydrogen.

An identical steel strip was induction heated to 746° C. at a heating rate of 250° C./s and then, without being cooled, was heated to 850° C. at 15° C./s and decarburization annealed in wet hydrogen.

The two types of decarburization annealed strips were coated with MgO powder and then high-temperature annealed in a hydrogen gas atmosphere at 1200° C. for 10 hours.

(Example 4)

2.3 mm hot rolled strips of the chemical composition shown in Table 7 were annealed at 1100° C. for 1 minute and then cold rolled to a final thickness of 0.27 mm.

Different ones of the so-obtained strips were heated to 840° C. at 10° C./s, 115° C./s and 300° C./s during the heating phase of decarburization annealing and then immediately cooled to 750° C. at the rate of 20000° C./s. The respective atmosphere conditions at this time are shown in Table 8. Each strip was then decarburization annealed in wet hydrogen at a uniform temperature of 840° C., coated with MgO powder and then high-temperature annealed in a hydrogen gas atmosphere at 1200° C. for 10 hours. Excess MgO was removed from the resulting strips and an insulating film was applied over the forsterite film that had formed thereon.

Table 8 shows the magnetic properties of the products obtained. The invention produced grain-oriented electrical steel sheets with excellent core loss property.

TABLE 7

| (wt %) | | | | | | |
|---|---|---|---|---|---|---|
| C | Si | Mn | P | S | sol. Al | N |
| 0.070 | 3.15 | 0.083 | 0.008 | 0.023 | 0.0280 | 0.0087 |

TABLE 8

| Test conditions | Decarb annealing heating rate (°C./s) | $P_{H2O}/P_{H2}$ | Max. flux density $B_8$ (T) | Core loss $W_{17/50}$ (kg/W) | Forsterite film condition | Remark |
|---|---|---|---|---|---|---|
| A | 10 | 0.30 | 1.91 | 0.98 | Good | Comp. Ex |
| B | 10 | 0.15 | 1.91 | 1.02 | Good | Comp. Ex |
| C | 115 | 0.30 | 1.88 | 1.10 | Poor | Comp. Ex |
| D | 115 | 0.10 | 1.92 | 0.88 | Good | Invnt'n |
| E | 300 | 0.35 | 1.90 | 0.93 | Poor | Comp. Ex |
| F | 300 | 0.30 | 1.91 | 0.94 | Poor | Comp. Ex |
| G | 300 | 0.15 | 1.93 | 0.87 | Good | Invnt'n |
| H | 300 | 0.10 | 1.43 | 0.86 | Good | Invnt'n |

(Example 5)

2.3 mm hot rolled strips of the chemical composition shown in Table 9 were annealed at 1100° C. for 1 minute and then cold rolled to a final thickness of 0.27 mm either with annealing being conducted at a strip temperature of 200° C. for 2 minutes during rolling or with rolling being conducted at normal temperature (30° C.).

The two types of rolled strips were heated to 845° C. at a heating rate of 290° C./s by two pairs of direct electric heating rolls and then cooled to 750° C. at 24000° C./s. Each strip was then decarburization annealed in wet hydrogen at a uniform temperature of 845° C., coated with MgO powder and then high-temperature annealed in a hydrogen gas atmosphere at 1200° C. for 10 hours. Excess MgO was removed from the resulting strips and an insulating film was applied over the forsterite film that had formed thereon. Table 10 shows the magnetic properties of the products obtained. The invention produced grain-oriented electrical steel sheets with excellent core loss property.

TABLE 9

| (wt %) | | | | | | |
|---|---|---|---|---|---|---|
| C | Si | Mn | P | S | sol. Al | N |
| 0.070 | 3.15 | 0.083 | 0.008 | 0.023 | 0.0280 | 0.0087 |

TABLE 10

| Test conditions | Heating rate (°C./s) | Heat treatment during rolling? | Mag. flux density $B_8$ (T) | Core loss $W_{17/50}$ (kg/W) | Remark |
|---|---|---|---|---|---|
| A | 290 | Yes | 1.94 | 0.82 | Invnt'n |
| B | 290 | No | 1.92 | 0.93 | Comp. Ex |

(Example 6)

Table 11 shows the secondary recrystallization grain diameter and the average deviations of the orientation of the secondary recrystallization grains with diameters not greater than 10 mm from the rolling direction and the sheet plane direction with respect to the ideal (110) [001] orientation.

Since the grain-oriented electrical steel sheets according to the invention have a grain diameter of 1–10 mm and exhibit grain orientations that on average deviate from the ideal (110) [001] direction by not more than 4° in the rolling direction and between 1° and 3° in the sheet plane direction, they have very low core losses.

TABLE 11

| Test conditions | Heating rate (°C./s) | Max. temp. (°C.) | Cooling rate (°C./s) | Mag. flux density $B_8$ (T) | Core loss $W_{17/50}$ (kg/W) | 2ndry recrystallization grain dia. (mm) | Dev. from rolling direction (°) | Dev. from sheet plane direction (°) | Remark |
|---|---|---|---|---|---|---|---|---|---|
| H | 144 | 851 | 20 | 1.92 | 0.91 | 5.5 | 4.3 | 4.1 | Comp. Ex |
| I | 132 | 505 | 24000 | 1.89 | 0.89 | 18.7 | 5.1 | 1.2 | Comp. Ex |
| J | 135 | 620 | 24000 | 1.90 | 0.91 | 19.5 | 4.5 | 3.1 | Comp. Ex |
| K | 86 | 705 | 220 | 1.94 | 0.84 | 5.0 | 2.6 | 1.7 | Invnt'n |
| L | 141 | 863 | 240 | 1.93 | 0.88 | 3.1 | 3.1 | 1.8 | Invnt'n |
| M | 150 | 850 | 1600 | 1.93 | 0.82 | 3.1 | 2.4 | 2.1 | Invnt'n |

(Example 7)

A steel melt including the components shown in Table 12 was cast and the resulting slab was heated and then hot rolled into a 2.3 mm hot rolled strip. The strip was annealed at 1100° C. for 5 min, pickled, and then cold rolled to a thickness of 0.22 mm. The rolled strip was heated to 851° C. at a heating rate of 250° C./s by two pairs of direct electric heating rolls and 0.01 second after reaching its maximum temperature was cooled by the exit side roll to 790° C. at a cooling rate of 24500° C./s. It was then decarburization annealed in wet hydrogen.

The decarburization annealed strip was coated with MgO powder and then high-temperature annealed in a hydrogen gas atmosphere at 1200° C. for 10 hours.

Since the so-obtained grain-oriented electrical steel sheet had a grain diameter of 2.3 mm and exhibited a grain orientation that on average deviated from the ideal (110) [001] direction by 1.2° in the rolling direction and 1.7° in the sheet plane direction, it had a very low core loss $W_{17/50}$ of 0.66 (kg/W) a magnetic flux density $B_8$ of 1.96 (T).

TABLE 12

| (wt %) | | | | | | | |
|---|---|---|---|---|---|---|---|
| C | Si | Mn | P | S | sol. Al | N | Bi |
| 0.070 | 3.15 | 0.083 | 0.008 | 0.023 | 0.0280 | 0.0087 | 0.0067 |

We claim:

1. A method of producing a grain-oriented electrical steel sheet with a very low core loss comprising the steps of obtaining a rolled strip of intermediate product thickness using as a starting material molten steel consisting essentially of not more than 0.10 wt % C, 2.5–7.0 wt % Si, 0.02–0.15 wt % Mn, 0.001–0.050 wt % S, 0.010–0.040 wt % soluble Al, 0.0030–0.0200 wt % N, with a member selected from the group consisting of AlN, MnS and a mixture thereof as an inhibitor component and the balance iron and unavoidable impurities; subjecting the strip to hot rolling and a single cold rolling to obtain a rolled strip of final product thickness in which the single cold rolling results in obtaining a high flux density in the steel sheet; decarburization annealing the strip by a decarburization annealing process that includes a heating phase wherein the rolled strip of final product thickness in the heating phase of the decarburization annealing is rapidly heated to a temperature range of not less than 700° C. at a heating rate of not less than 80° C./s by passing electric current through the rolled strip at an entry side of a heater; cooling the heated strip at an exit side of the heater to a temperature range of 600°–840° C. at a cooling rate of not less than 50° C./s within 0.1 second after the temperature range of not less than 700° C. has been reached, the rapid heating and cooling being incorporated into the heating phase of the decarburization annealing and carried out in a non-oxidizing atmosphere to suppress formation of fayalite and to obtain forsterite during final finish annealing, whereby primary recrystallization grains are obtained having a precipitate size on the order of 100 Å; and subjecting the strip to final finish annealing and decarburization annealing to obtain fine secondary recrystallization grains in which the primary recrystallization grain texture is maintained.

2. A method of producing a grain-oriented electrical steel sheet with a very low core loss according to claim 1, wherein rapidly heating and cooling the rolled strip of final product thickness in the heating phase of the decarburization annealing comprises the steps of rapidly heating the rolled strip to a temperature range of not less than 700° C. at a heating rate of not less than 80° C./s by passing electric current through the rolled strip between rolls at the entry side and rolls at the exit side of the heater to heat the rolled strip, and cooling the heated strip at the exit side by controlling the temperature of the exit side rolls to a temperature range of 600°–840° C. at a cooling rate of not less than 50° C./s within 0.1 second after the maximum temperature has been reached in the heating step.

3. A method of producing a grain-oriented electrical steel sheet with a very low core loss according to claims 1 or 2, further comprising a step of subjecting the grain-oriented electrical steel sheet to a treatment for magnetic domain subdivision.

* * * * *